US010138900B2

(12) United States Patent
Andersson et al.

(10) Patent No.: US 10,138,900 B2
(45) Date of Patent: Nov. 27, 2018

(54) GAS TURBINE COMPRISING A COMPRESSOR CASING WITH AN INLET OPENING FOR TEMPERING THE COMPRESSOR CASING AND USE OF THE GAS TURBINE

(71) Applicant: Siemens Aktiengesellschaft, Munich (DE)

(72) Inventors: Thomas Andersson, Linkoping (SE); Allan Persson, Norrkoping (SE)

(73) Assignee: Siemens Aktiengesellschaft, Munich (DE)

( * ) Notice: Subject to any disclaimer, the term of this patent is extended or adjusted under 35 U.S.C. 154(b) by 297 days.

(21) Appl. No.: 14/898,131

(22) PCT Filed: Jun. 3, 2014

(86) PCT No.: PCT/EP2014/061415
§ 371 (c)(1),
(2) Date: Dec. 13, 2015

(87) PCT Pub. No.: WO2014/206689
PCT Pub. Date: Dec. 31, 2014

(65) Prior Publication Data

US 2016/0131159 A1 May 12, 2016

(30) Foreign Application Priority Data

Jun. 28, 2013 (EP) ..... 13174310

(51) Int. Cl.
*F04D 29/58* (2006.01)
*F04D 29/52* (2006.01)
(Continued)

(52) U.S. Cl.
CPC ..... *F04D 29/584* (2013.01); *F01D 11/24* (2013.01); *F01D 25/26* (2013.01); *F04D 19/00* (2013.01);
(Continued)

(58) Field of Classification Search
CPC ..... F04D 29/584; F04D 29/58; F04D 29/582; F04D 29/5846; F01D 25/26; F01D 11/20; F01D 11/24; F01D 25/12
See application file for complete search history.

(56) References Cited

U.S. PATENT DOCUMENTS 5,415,478 A 5/1995 Matthews et al.
5,605,437 A * 2/1997 Meylan ..... F01D 11/24 415/1
(Continued)

FOREIGN PATENT DOCUMENTS

CN 1312883 A 9/2001
DE 4324125 A1 * 1/1995 ..... F01D 11/24
(Continued)

OTHER PUBLICATIONS

Machine Translation of DE 4324125 A1.*
RU Office Action dated Mar. 31, 2017, for RU patent application No. 2016102745.

*Primary Examiner* — Logan Kraft
*Assistant Examiner* — Elton Wong
(74) *Attorney, Agent, or Firm* — Beusse Wolter Sanks & Maire

(57) ABSTRACT

A gas turbine includes at least one rotor assembly and at least one compressor casing. The compressor casing has at least one inner compressor casing chamber for arranging the rotor assembly and at least one outer compressor casing chamber for tempering the compressor casing. The inner and outer compressor casing chambers are separated from each other by a separating casing wall. The outer compressor
(Continued)

casing chamber has at least one boundary casing wall. The boundary casing wall and the separating casing wall are oppositely spaced such that the outer compressor casing chamber is formed. The boundary casing wall has at least one inlet opening for leading in an inlet tempering gas flow with tempering gas into the outer compressor casing chamber such that a tangential material temperature variation of the compressor casing is reduced in comparison to a non tempered compressor casing.

12 Claims, 1 Drawing Sheet

(51) Int. Cl.
*F04D 19/00* (2006.01)
*F01D 11/24* (2006.01)
*F01D 25/26* (2006.01)

(52) U.S. Cl.
CPC ..... *F04D 29/522* (2013.01); *F05D 2260/20* (2013.01)

(56) References Cited

U.S. PATENT DOCUMENTS

| | | | | |
|---|---|---|---|---|
| 7,329,084 | B2 | 2/2008 | Dittmann et al. | |
| 2001/0022933 | A1* | 9/2001 | Bangert | F01D 25/12 415/1 |
| 2003/0035719 | A1* | 2/2003 | Wadia | F01D 25/02 415/145 |
| 2004/0228723 | A1* | 11/2004 | Dittmann | F01D 25/12 415/117 |
| 2008/0253884 | A1* | 10/2008 | Snyder | F01D 25/26 415/208.1 |

FOREIGN PATENT DOCUMENTS

| | | | |
|---|---|---|---|
| DE | 102006012363 | A1 | 10/2006 |
| EP | 2500528 | A1 | 9/2012 |
| RU | 2132474 | C1 | 6/1999 |

* cited by examiner

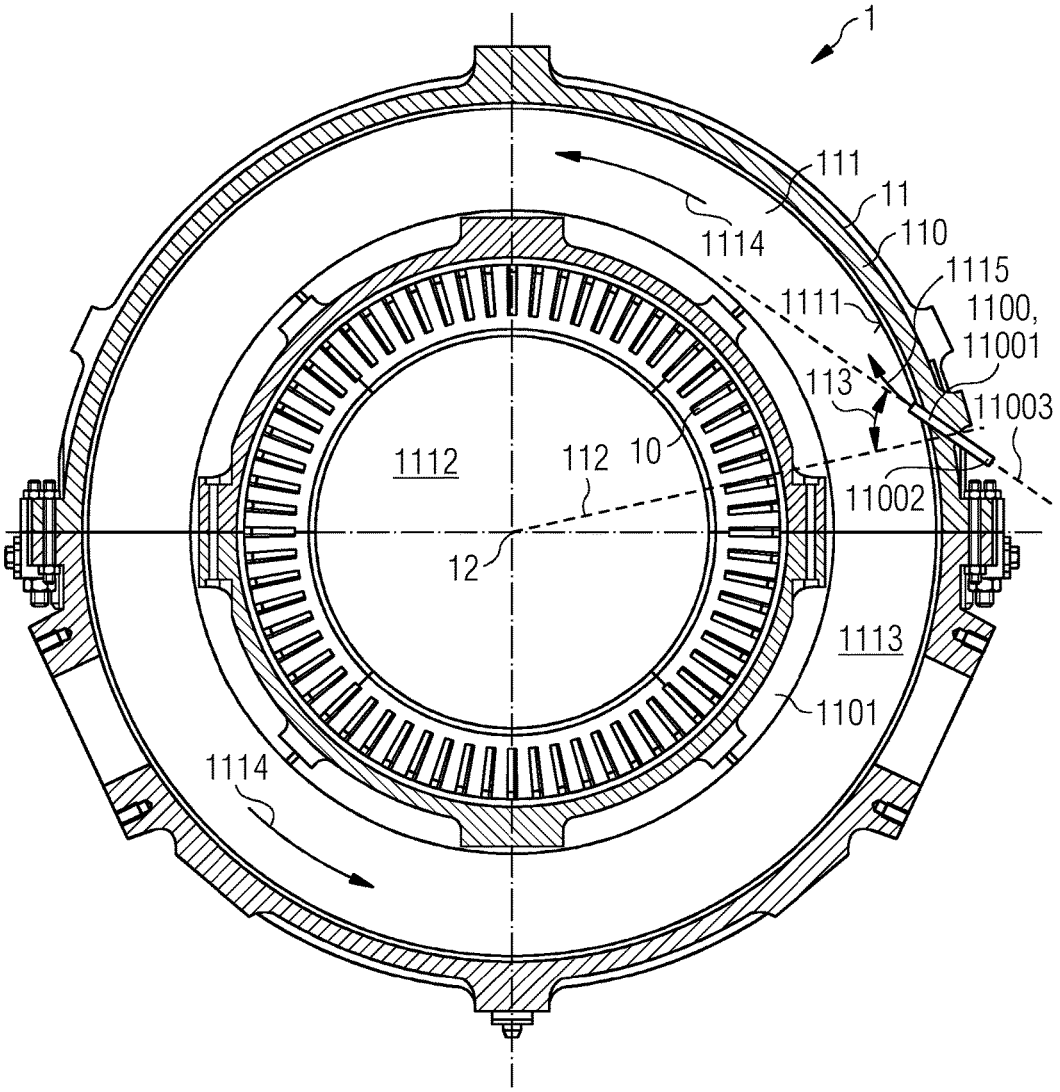
1
111
11
110
1114
1115
1111
1100,
11001
113
11003
1112
112
10
11002
12
1113
1101
1114

GAS TURBINE COMPRISING A COMPRESSOR CASING WITH AN INLET OPENING FOR TEMPERING THE COMPRESSOR CASING AND USE OF THE GAS TURBINE

CROSS REFERENCE TO RELATED APPLICATIONS

This application is the U.S. National Stage of International Application No. PCT/EP2014/061415 filed Jun. 3, 2014, and claims the benefit thereof. The International Application claims the benefit of European Application No. EP13174310 filed Jun. 28, 2013. All of the applications are incorporated by reference herein in their entirety.

FIELD OF THE INVENTION

This invention relates to a gas turbine with a compressor casing and a use of the gas turbine.

BACKGROUND OF INVENTION

The gas turbine comprises a rotor assembly (at least one movable part) and a compressor casing (at least one fixed part). The rotor assembly, which is driven by a working fluid through the gas turbine, is located in the compressor casing.

Thermal stratification in internal chambers (internal cavities) of the compressor casing is commonly observed in industrial gas turbines. This phenomenon can often be observed shortly after shut down of the gas turbine. In the casing temperature differences can be observed. The temperature differences cause lateral deformation of the compressor casing relatively to the rotor assembly of the turbine. Hence a rubbing of the rotor assembly on an inner surface of the casing can occur.

SUMMARY OF THE INVENTION

It is an object of the invention to provide a turbine for which a probability for an occurrence of a temperature induced rubbing of the rotor assembly on an inner surface of a compressor casing is reduced in comparison to the state of the art.

It is another object of the invention to provide a use of the turbine.

These objects are achieved by the invention specified by the claims. Thereby a turbine is provided comprising at least one rotor assembly; and at least one compressor casing; wherein the compressor casing comprises at least one inner compressor casing chamber for arranging the rotor assembly and at least one outer compressor casing chamber for tempering the compressor casing; the inner compressor casing chamber and the outer compressor casing chamber are separated from each other by a separating casing wall; the outer compressor casing chamber comprises at least one boundary casing wall; the boundary casing wall and the separating casing wall are oppositely spaced from each other such that the outer compressor casing chamber is formed; and the boundary casing wall comprises at least one inlet opening for leading in an inlet tempering gas flow with tempering gas into the outer compressor casing chamber such that a tangential material temperature variation of the compressor casing is reduced in comparison to a non tempered compressor casing. The tempering gas flow is a tempering gas jet. There is a gas jet of tempering gas along a surface of compressor casing, e.g. along a surface of the boundary casing wall or along a surface of an inner compressor chamber wall. Along the surface of the boundary casing wall or along the surface of the inner compressor chamber wall the temperature differences are balanced. By this the probability for the occurrence "hot spots" of the compressor casing is reduced. Thereby the problem of the above described problem of thermal stratification in gas turbines is reduced. Rubbing doesn't occur.

Advantageously more inlet openings are distributed alongside an internal surface of the boundary casing wall in order to reduce efficiently the thermal stratification problem.

The rotor assembly can be driven by a working fluid. The working fluid comprises a gas. In particular the gas is exhaust gas of a combustion process. The exhaust gas is hot combustion gas.

The compressor casing chamber is spatially limited by the inner separating casing wall and the outer boundary casing wall. With the aid of the inlet opening the inlet tempering gas flow can be led into the compressor casing chamber. Tempering gas, especially air, can be injected into the compressor casing chamber. With the aid of the inlet tempering gas flow the tempering of the compressor casing takes place. The tempering is in particular a cooling of the compressor casing. With the aid of the circulating tempering gas flow the possibility for the occurrence of stratification is reduced. In addition, an absorption of thermal energy by gas molecules of the inlet tempering gas flow and a distribution of this absorbed thermal energy alongside the compressor casing wall will result. Temperature differences within the compressor casing, which especially might appear while a shut down operational state of a gas turbine, are balanced resulting in a reduction of a possibility for the occurrence of temperature induced deformation of the compressor casing. The rotor assembly can be form fit located in the inner compressor casing chamber such that the rotor assembly can rotate in the inner compressor casing chamber driven by a working fluid. Rubbing due to temperature induced deformation of the compressor casing will not occur.

Thereby a complete separation of the tempering gas and the working fluid is ensured. Tempering fluid, e.g. tempering gas, and working gas of the turbine are not mixed up. The complete separation is ensured by the separating casing wall.

The tempering gas flow can comprise different gases or gas mixtures. In a further embodiment the tempering gas comprises air. Air is a very efficient and unlimited available tempering gas. Alternatively other gases or gas mixtures are possible. For instance, the tempering gas can be nitrogen.

The boundary casing wall can comprise at least one outlet opening for leading out an outlet tempering gas flow with tempering gas out of the outer compressor casing chamber. But this is not necessary. The tempering gas flow can flow into a gas path of the compressor through a bleed extraction slot in and not through the outer compressor casing chamber.

It is advantageous that the tempering doesn't take place uncontrolled. Therefore, in particular at least one tempering gas flow adjusting unit for adjusting the tempering inlet gas flow is provided. If outlet openings are provided it is advantageous to adjust the outlet tempering gas flow, too. So, there are tempering gas flow adjusting units for the tempering outlet gas flow.

In a particular embodiment, the tempering gas flow adjusting unit comprises at least one valve and/or at least one nozzle. For instance, the tempering gas flow adjusting unit is a nozzle which is incorporated into the boundary casing wall. In particular, this nozzle is incorporated with a tangential alignment of its longitudinal direction. The nozzle is tangentially oriented. By this, an orientation of a channel of the nozzle and a radial direction of the chamber form an angle which is selected from the range between 45° and 85°. For instance, this angle is approximately 50°. By this, the tempering gas is injected into the outer chamber in a tangential way. Additional devices like a fan and/or a blower can be implemented, too.

In a further embodiment the tempering gas can be injected into the outer compressor casing chamber in such a way that a circumferential movement of gas molecules of the tempering gas and/or a tangential movement of gas molecules of the tempering gas alongside an interior chamber surface of the boundary casing wall and/or alongside an interior surface of the inner separating wall results. By this measure the balance of temperature is reached very efficiently. No thermal peaks can be detected. For instance, external air is injected through the casing wall in such a way that a circumferential movement of the air inside the cavity (outer compressor casing chamber) is obtained. Thereby a tangential position of a used nozzle (see above: nozzle with tangential alignment) and an angle of an injected air jet is selected in such a way that the air jet will hit and thereby cool the casing wall at the centre of the area where the material temperature is highest i.e. at the top vertical position of the compressor casing chamber. Thereby the thermal stratification inside the compressor casing chamber is efficiently reduced.

The inlet opening is used in a gas turbine engine. Thereby tempering gas molecules are injected into the compressor casing chamber via the inlet nozzle during at least one operational status of the turbine engine. The operational status is selected from the group consisting of a run-up of the gas turbine engine and a shut down of the gas turbine engine. In particular air is used for the tempering gas jet.

BRIEF DESCRIPTION OF THE DRAWING

Further features and advantages of the invention are produced from the description of an exemplary embodiment with reference to the drawing.

The drawing shows schematically a cross section of the gas turbine.

DETAILED DESCRIPTION OF THE INVENTION

Subject matter is a turbine 1 which comprises at least one rotor assembly 10 and at least one compressor casing 11. The turbine 1 is a gas turbine. Exhaust combustion gas is the working fluid of the gas turbine 1 which drives the rotor assembly 10 of the turbine 1.

The compressor casing comprises at least one inner compressor casing chamber 1112 for arranging the rotor assembly and at least one outer compressor casing chamber 1113 for compressor bleed air extraction. The rotor assembly is located in the inner compressor casing chamber such that the rotor assembly and the compressor casing are co-axially arranged to each other. These elements comprise a joint rotational axis 12.

The inner compressor casing chamber 1112 and the outer compressor casing chamber 1113 are separated from each other by a separating casing wall 1101. The outer compressor casing chamber 1113 comprises at least one boundary casing wall 110. The boundary casing wall 110 and the separating casing wall 1101 are oppositely spaced from each other such that the outer compressor casing chamber 1113 is formed.

The boundary casing wall 110 comprises at least one inlet opening 1100 for leading in an inlet tempering gas flow 1115 with tempering gas into the outer compressor casing chamber 1113 for the tempering the compressor casing. At least one adjusting unit for adjusting the tempering inlet gas flow is provided. The tempering gas flow adjusting unit is a nozzle 11001.

The nozzle 11001 is tangentially oriented. By this, an orientation 11003 of a channel 11002 of the nozzle 11001 and a radial direction 112 of the chamber 11 form an angle 113 of approximately 45°.

Via the inlet opening and nozzle respectively, a tempering gas jet with gas molecules can be injected into the compressor outer compressor casing chamber. The tempering gas jet comprises air with nitrogen and oxygen as tempering gas molecules.

The tempering gas jet can be injected in such a way that a circumferential movement 1114 of the gas molecules of the tempering gas jet results. Moreover, the tempering gas jet is injected into the outer casing 1113 such that a tangential movement of the gas molecules of the tempering gas jet alongside an interior surface 1111 of stator boundary wall results.

The gas turbine is used in a gas turbine engine. Thereby tempering gas molecules are injected into the outer chasing chamber 1113 via the inlet openings 1100 during at least one operational status of the gas turbine engine. The operational status is a shut down of the gas turbine engine. By injecting the tempering gas into the outer compressor casing chamber tangential temperature differences are balanced. This results in less thermal distortion of the compressor casing in comparison to a gas turbine without the use of a tempering gas jet.

The invention claimed is:

1. A gas turbine comprising at least one rotor assembly; and at least one compressor casing;

wherein the at least one compressor casing comprises at least one inner compressor casing chamber adapted for arranging the at least one rotor assembly and at least one outer compressor casing chamber adapted for tempering the at least one compressor casing;

the at least one inner compressor casing chamber and the at least one outer compressor casing chamber are separated from each other by a separating casing wall;

the at least one outer compressor casing chamber comprises at least one boundary casing wall;

the at least one boundary casing wall and the separating casing wall are oppositely spaced from each other such that the at least one outer compressor casing chamber is formed;

the at least one boundary casing wall comprises at least one inlet opening configured to inject a jet comprising inlet tempering gas into the at least one outer compressor casing chamber for tempering the at least one compressor casing such that a tangential material temperature variation of the at least one compressor casing is reduced in comparison to a non tempered compressor casing, wherein the at least one inlet opening is configured to inject the jet along a trajectory comprising a circumferential component, and wherein a circumferential location of the at least one inlet opening and the trajectory are selected so the jet hits and cools a top of the separating casing wall, and wherein the trajectory is selected to be tangential to the separating casing wall.

2. The gas turbine according to claim 1, further comprising at least one tempering gas flow adjusting unit adapted for adjusting the jet.

3. The gas turbine according to claim 2, wherein the at least one tempering gas flow adjusting unit comprises at least one of a valve and at least one nozzle.

4. The gas turbine according claim 1, wherein the at least one outer compressor casing chamber surrounds the at least one inner compressor casing chamber at least partly.

5. The gas turbine according to claim 1, wherein the inlet tempering gas comprises air.

6. The gas turbine according to claim 1, wherein the trajectory of the jet into the at least one outer compressor casing chamber generates a circumferential movement of the inlet tempering gas alongside at least one of an interior chamber surface of the at least one boundary casing wall and a surface of the separating casing wall.

7. The gas turbine according to claim 1, wherein the circumferential location is relatively lower than the top of the separating casing wall.

8. A method of using a gas turbine in a gas turbine engine, the gas turbine comprising:

at least one rotor assembly; and at least one compressor casing;

wherein the at least one compressor casing comprises at least one inner compressor casing chamber adapted for arranging the at least one rotor assembly and at least one outer compressor casing chamber adapted for tempering the at least one compressor casing;

wherein the at least one inner compressor casing chamber and the at least one outer compressor casing chamber are separated from each other by a separating casing wall;

wherein the at least one outer compressor casing chamber comprises at least one boundary casing wall;

wherein the at least one boundary casing wall and the separating casing wall are oppositely spaced from each other such that the at least one outer compressor casing chamber is formed;

wherein the at least one boundary casing wall comprises at least one inlet opening configured to inject a jet comprising inlet tempering gas into the at least one outer compressor casing chamber for tempering the at least one compressor casing such that a tangential material temperature variation of the at least one compressor casing is reduced in comparison to a non tempered compressor casing, and wherein the at least one inlet opening is configured to inject the jet along a trajectory comprising a circumferential component, and wherein a circumferential location of the at least one inlet opening and the trajectory are selected so the jet hits and cools a top of the separating casing wall, the method comprising:

injecting tempering gas molecules into the at least one outer compressor casing chamber via the at least one inlet opening during at least one operational status of the gas turbine engine, wherein the at least one operational status is selected from the group consisting of a run-up of the gas turbine engine and a shut down of the gas turbine engine.

9. The method according to claim 8, wherein air is used as the inlet tempering gas.

10. A gas turbine, comprising:

a rotor assembly;

a separating casing concentrically surrounding the rotor assembly; and a boundary casing concentrically surrounding the separating casing and comprising an inlet opening;

wherein the boundary casing and the separating casing define an outer compressor casing chamber therebetween;

wherein the inlet opening is configured to inject a jet of tempering gas into the outer compressor casing chamber along a trajectory comprising a circumferential component, wherein a circumferential location of the inlet opening in the boundary casing and the trajectory are selected so the jet hits and cools a top of the separating casing, and wherein the circumferential location is circumferentially offset from the top of the separating casing, and wherein the trajectory is selected to be tangential to the separating casing.

11. The gas turbine of claim 10, wherein the circumferential location is relatively lower than the top of the separating casing.

12. The gas turbine of claim 10, further comprising a nozzle or a valve configured to adjust a flow rate of the jet of tempering gas.

* * * * *